US009182198B2

(12) United States Patent
Cooper

(10) Patent No.: US 9,182,198 B2
(45) Date of Patent: Nov. 10, 2015

(54) WEARABLE PERSONAL PROTECTION DEVICE WITH SAFETY MECHANISM

(75) Inventor: Stephen Bradley Cooper, Houston, TX (US)

(73) Assignee: FOSOL, LLC, Houston, TX (US)

( * ) Notice: Subject to any disclaimer, the term of this patent is extended or adjusted under 35 U.S.C. 154(b) by 599 days.

(21) Appl. No.: 13/530,219

(22) Filed: Jun. 22, 2012

(65) Prior Publication Data

US 2013/0320104 A1 Dec. 5, 2013

Related U.S. Application Data

(60) Provisional application No. 61/652,417, filed on May 29, 2012.

(51) Int. Cl.
*F41H 9/10* (2006.01)
*A41D 19/015* (2006.01)

(52) U.S. Cl.
CPC ..... *F41H 9/10* (2013.01); *A41D 19/01594* (2013.01)

(58) Field of Classification Search
CPC ..... A14D 19/0024; A41D 19/015; A41D 19/01594
USPC ..... 239/153, 154, 529; 222/78, 175; 200/DIG. 2; 221/185; 2/159, 160, 163, 2/169, 905, 16, 20, 161.1, 161.6; 42/1.08, 1.09, 1.11; 224/148.1, 148.2
See application file for complete search history.

(56) References Cited

U.S. PATENT DOCUMENTS

| | | | | |
|---|---|---|---|---|
| 1,165,970 | A | 12/1915 | Harris | |
| 1,558,930 | A * | 10/1925 | Schuck | 239/529 |
| 4,337,496 | A | 6/1982 | Laird | |
| 4,768,681 | A | 9/1988 | Dean et al. | |
| 4,903,864 | A * | 2/1990 | Sirhan | 222/78 |
| 4,997,110 | A | 3/1991 | Swenson | |
| 5,088,121 | A | 2/1992 | Wallace | |
| 5,120,304 | A * | 6/1992 | Sasaki | 604/35 |
| 5,177,467 | A * | 1/1993 | Chung-Piao | 340/574 |
| 5,289,164 | A | 2/1994 | Novak | |
| 5,484,085 | A | 1/1996 | Bennett | |
| 5,673,436 | A * | 10/1997 | Piper | 2/160 |
| 6,966,462 | B1 | 11/2005 | Torrence | |
| 7,478,768 | B2 * | 1/2009 | Yip | 239/529 |
| 2004/0154071 | A1 | 8/2004 | Frahm | |
| 2006/0010745 | A1 * | 1/2006 | Fleischhauer et al. | 42/1.08 |
| 2011/0265364 | A1 | 11/2011 | Hayden | |
| 2013/0269136 | A1 * | 10/2013 | Boulton et al. | 15/227 |

OTHER PUBLICATIONS

PCT/US2013/042893 International Search Report and Written Opinion Dated Sep. 2, 2013 (12 p.).

* cited by examiner

*Primary Examiner* — Arthur O Hall
*Assistant Examiner* — Christopher R Dandridge
(74) *Attorney, Agent, or Firm* — Conley Rose, P.C.

(57) ABSTRACT

A personal protection apparatus includes a glove; a reservoir supported on the glove, and housing a sprayable repellant therein; a valve electrically operable to control the flow of fluid from the reservoir into a delivery tube; and a switch for actuating the valve. The switch includes contacts on thumb and index finger portions of the glove so as to close the switch and activate the spray of repellant when the thumb is positioned between the index finger and middle finger.

18 Claims, 4 Drawing Sheets

WEARABLE PERSONAL PROTECTION DEVICE WITH SAFETY MECHANISM

CROSS-REFERENCE TO RELATED APPLICATIONS

This application claims the benefit under 35 U.S. §119(e) of U.S. Provisional Patent Application No. 61/652,417 filed May 29, 2012 the disclosure of which is hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

FIELD OF THE DISCLOSURE

This disclosure generally relates to personal protection devices that can be worn by the user of the device.

BACKGROUND OF THE DISCLOSURE

Being attacked or assaulted is often a function of an assailant surprising their potential victim when the victim is unarmed or unprepared (even if the victim is in possession of a self-defense device (e.g. pepper spray) or armed with a weapon). The threat of accidental discharge of a weapon, or the hindrance caused by having to have a weapon or other self-defense device in-hand and at the ready, may lead to the device not being carried routinely in circumstances where the user could be vulnerable (e.g. any poorly lit and/or scarcely populated area like dark parking lots, public streets or parks, or parking garages and subways).

Known personal defense devices (Piper, U.S. Pat. No. 5,673,436, and Torrence, U.S. Pat. No. 6,966,462) have been designed, such devices have had a single mechanical actuator or electronic button that activated the spraying of the irritant. However, this single button or mechanism was positioned in an area where the wearer could either routinely touch the button with normal motion of the hand, or the button was on the outside of the hand where it could accidentally come in contact with other objects. Thus, the button was highly vulnerable to being accidentally depressed if the wearer of the device tried to wear it and carry on normal activities and hand motions (e.g. put the hand wearing the device into a pocket or purse or simply brush the hand wearing the device against a solid object). A primary disadvantage of the prior devices is the unintentional spraying of repellant.

There remains a need for a device that can be worn on the hand that is immediately available to discharge a repellant such as irritants (e.g. tear gas) or inflammatory agents (e.g. pepper spray), but that cannot be accidentally discharged or hinder the normal use of the hand upon which the device is worn.

SUMMARY OF THE PRESENT DISCLOSURE

The embodiments described herein are generally directed to a personal protection apparatus comprising a glove, a reservoir supported on the glove, a fluid delivery tube in fluid communication with the reservoir, a valve electrically operable to open and close and thereby control the flow of fluid from the reservoir into the delivery tube; a power supply supported on the glove; and a switch supported on the glove for electrically coupling the valve and the power supply.

In an embodiment, a personal protection apparatus for a wearer comprises a glove comprising an index finger covering and a thumb covering, the index finger covering including a first switch contact and the thumb covering including a second switch contact. The first and second switch contacts are positioned on the glove so as to come into engagement with one another when the wearer's thumb is positioned between the wearer's index finger and middle finger. The personal protection apparatus further comprises a reservoir supported on the glove and adapted for containing a fluid repellant, and a fluid delivery tube in fluid communication with the reservoir, wherein at least a portion of the tube is supported by the thumb covering. The personal protection apparatus additionally comprises an electrically actuatable valve configured to control the flow of repellant from the reservoir and through the tube and a power supply supported by the glove and electrically coupled to the valve so as to actuate the valve when the first and second contacts are engaged.

The embodiments described herein are also generally directed to a method for actuating a switch, comprising placing a glove on the hand of a person, placing a thumb covering of the glove between an index finger covering and a middle finger covering of the glove, and connecting conductive electrical contacts on the bottom inside edge of the index finger covering with the top of the thumb covering between the knuckle and the thumb nail. Moreover, the glove comprises a reservoir configured to contain a fluid, a flexible tube, and a first and second electrical contact coupled to a power source and a valve.

Thus, embodiments described herein comprise a combination of features and characteristics intended to address various shortcomings associated with certain prior methods. The various features and characteristics described above, as well as others, will be readily apparent to those skilled in the art upon reading the following detailed description of the exemplary embodiments, and by referring to the accompanying drawings. It should be appreciated by those skilled in the art that the conception and the specific embodiments disclosed may be readily utilized as a basis for modifying or designing other structures for carrying out the same purposes of the embodiments described herein. It should also be realized by those skilled in the art that such equivalent constructions do not depart from the spirit and scope of the invention as set forth in the appended claims.

NOTATION AND NOMENCLATURE

Figure 1:
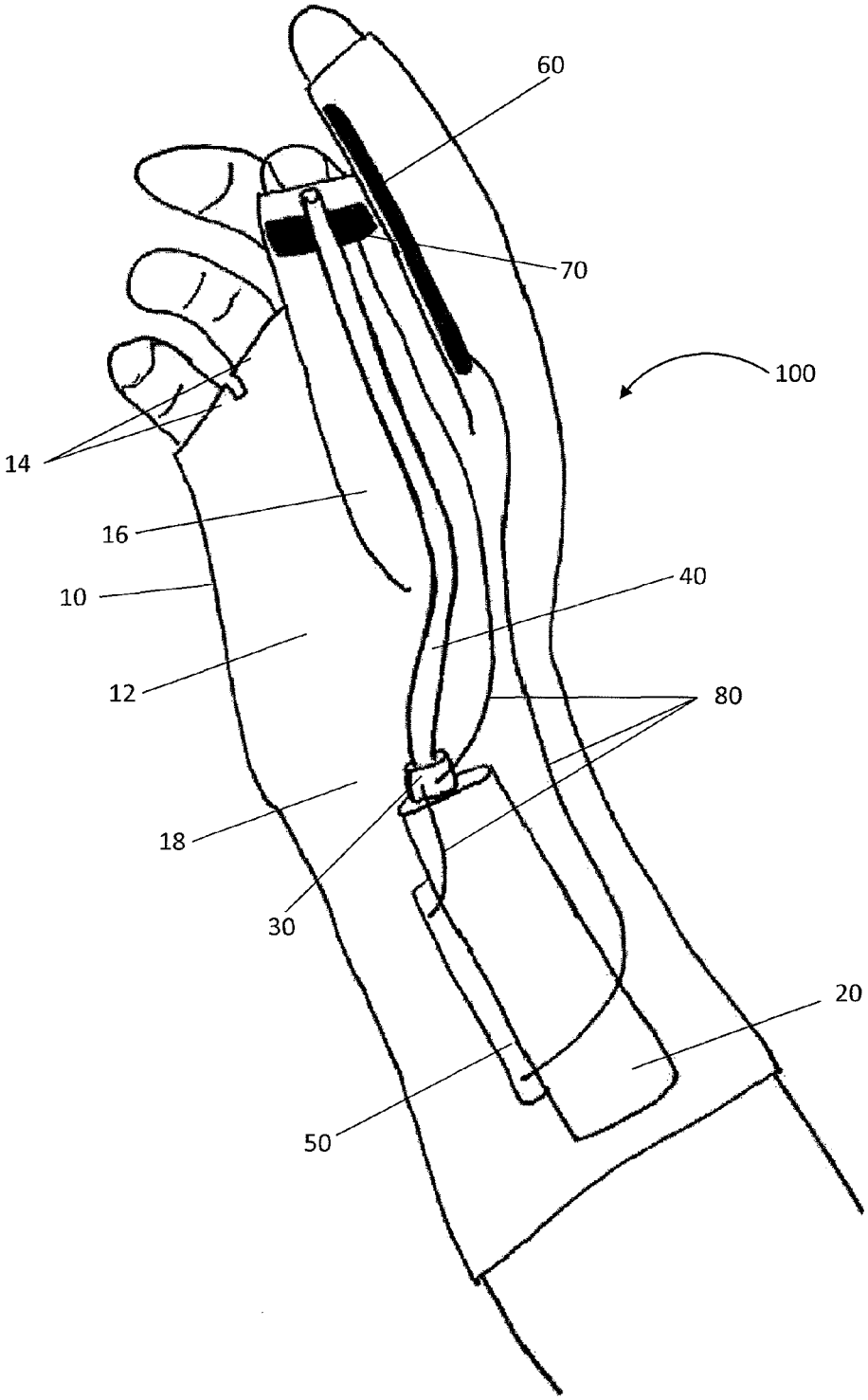
FIG. 1 is a perspective view of a right-handed embodiment of a personal protection device installed on a hand and made in accordance with the principles described herein.

The drawing figures are not necessarily to scale. Certain features of the disclosed embodiments may be shown exaggerated in scale or in somewhat schematic form, and some details of conventional elements may not be shown in the interest of clarity and conciseness.

In the following discussion and in the claims, the term "comprises" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct engagement of the two, or may be through an indirect connection via other intermediate devices, components, and connections.

DETAILED DESCRIPTION OF THE DISCLOSED EMBODIMENTS

The wearable personal protection device disclosed herein employs a hand configuration safety mechanism that is intended to address certain shortcomings associated with previous personal defense devices. The wearable personal protection device allows the wearer to have instant access to a self-defense device while allowing the wearer to safely maintain normal use of his/her hand when it is not necessary to activate and use the device. In some embodiments, the wearable personal protection device may be aimed in a similar manner as a handgun.

Referring to FIG. 1, an example of a personal protection device 100 installed on a right hand is shown. The personal protection device 100 may also be configured for and installed on a left hand. In an embodiment, the personal protection device 100 comprises a glove 10, a small reservoir 20, an electrically operated valve 30, a fluid delivery tube 40, a power supply 50, electrically conductive material 60, 70, and electrical wiring 80.

Referring still to FIG. 1, glove 10 generally includes a palm covering 12 that covers the wearer's palm, finger coverings 14, including a thumb covering 16, and a wrist covering 18. In the embodiment shown, the finger coverings 14 extend from the palm covering 12, but do not extend to and enclose the wearer's fingertips and, thus, do not cover the entire finger. Instead, to provide the wearer dexterity and tactile feedback, the finger coverings 14, including the thumb covering 16, leave the fingertips exposed in this embodiment. As best shown in FIG. 1, in this embodiment, the thumb covering 16 extends substantially to the proximal edge of the wearer's thumbnail.

The wrist covering 18 extends from the palm covering 12 and, in the embodiment shown in FIG. 1, extends a distance past the wearer's wrist and up the wearer's arm. This provides a convenient location to support other components of the system, described below.

As used herein, the term glove is meant to include a complete glove or a partial glove. A partial glove is one that at least partially covers the wearer's palm and includes at least a thumb covering and an index finger covering, where the thumb covering an index finger covering may extend and cover the fingertip of the wearer, or may leave the fingertip exposed as shown in FIG. 1.

Glove 10 shown in FIG. 1 is constructed from a single material that is compliant and that may be a natural material, such as leather or wool, or a man-made fabric or other material such as polyester or acrylic. In the embodiment shown in FIG. 1, the entire glove 10 is made from the same material; however, in other embodiments, the palm covering 12 may be made of a first material, with other portions, such as the finger coverings 14, as example, may be made of a second, different material.

In an embodiment, the small reservoir 20 comprises a form-fitting exterior shape, which is contoured or soft-sided to reduce the physical presence of the reservoir 20. Reservoir 20 may be made of plastic, metal, or any suitable material and is sized to contain several ounces of pressurized liquid or gas. In an embodiment, the reservoir 20 is attached to a portion of the material of the glove 10 that extends past the wrist. The reservoir 20 may be mounted on the material that covers the inside of the arm on which the glove 10 is worn. For example, elastic straps or hook-and-loop fasteners may be used to retain the reservoir 20 on the glove 10. Such fastening means permit the reservoir 20 to be removed for refilling or replaced with additional disposable reservoirs 20. The pressurized fluid may be a repellant, which may include pepper spray or other inflammatory agent, or tear gas or other irritant, for example. In another embodiment, the reservoir 20 may contain water or other liquid, allowing the device 100 to be used as a squirt toy.

Still referring to FIG. 1, an electrically operated valve 30 is disposed at an opening at the top of the reservoir 20 and is coupled to, and in fluid communication with, a fluid delivery tube 40. The valve 30 may be made of metal or any suitable material. Valve 30 is in fluid communication with the reservoir 20 and the fluid delivery tube 40.

In the embodiment shown in FIG. 1, the fluid delivery tube 40 is supported by and attached to the glove 10 and extends from the valve 30 over the side of the wrist, down the length of the thumb, and terminates on the top side of the thumb covering 16 of the glove 10. The fluid delivery tube 40 is flexible and made of plastic, rubber, or any suitable material. In the embodiment of FIG. 1, the tube 40 terminates at or within about 10 mm of the wearer's thumb nail.

Referring again to FIG. 1, a power supply 50 is disposed on the glove 10. The power supply 50 is shown in FIG. 1 disposed adjacent to the reservoir 20; however, the power supply 50 can be configured in different shapes and disposed in various locations on the glove 10. The power supply 50 may be a battery or other device used to store energy. Further, the power supply 50 may be attached in such a way that it is removable and replaceable. Elastic straps or hook-and-loop fasteners are examples of means to retain the power supply 50 on the glove 10.

Still referring to FIG. 1, the personal safety device 100 further comprises electrically conductive material 60, 70, forming electrical contacts of a switch 65 (discussed in greater detail below). The interior edge closest to the middle finger on the underside material of the index finger covering includes a strip 60 of an electrically conductive substance that is permanently adhered to the material of the glove 10. The top of the material on the thumb of the glove 10 between the thumb knuckle and thumb nail includes a strip 70 of an electrically conductive substance permanently adhered to the material of the glove 10. The conductive metallic substance of strips 60, 70 may be copper, silver, tape, or a type of metallic fabric, for example.

Figure 2:
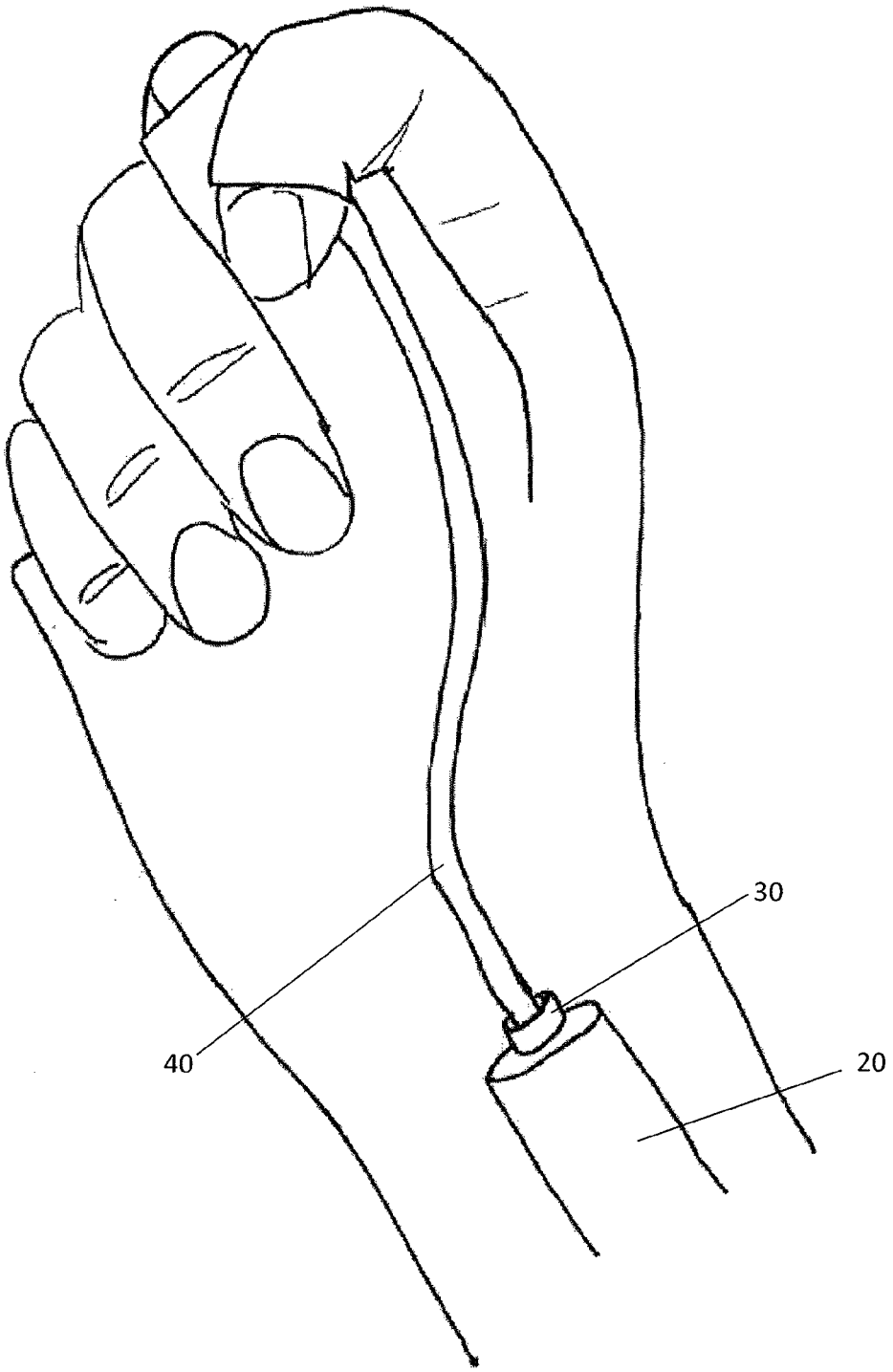
FIG. 2 is a perspective view of an embodiment of the device installed on a hand as the wearer makes the gesture that opens the valve to spray the pressurized liquid.

Referring now to FIG. 2, the conductive strip 60 on the index finger is aligned on the inside, lower edge of the index finger in such a way as to allow it to come in contact with the conductive strip 70 on the top of the thumb between the knuckle and the thumb nail if the wearer of the glove 10 were to place his/her thumb between the index and middle fingers while curling the fingers into a fist.

Referring again to FIG. 1, the personal safety device 100 further comprises electrical wiring 80, which is supported by and attachably connected to the glove 10. The electrical wiring 80 couples the two electrically conductive strips 60, 70 to the valve 30 and the power supply 50, and couples the valve 30 to the power supply 50. The electrical wiring 80 and the components in connection with the wiring 80 form an electrical circuit 85 shown in FIG. 3.

Figure 3:
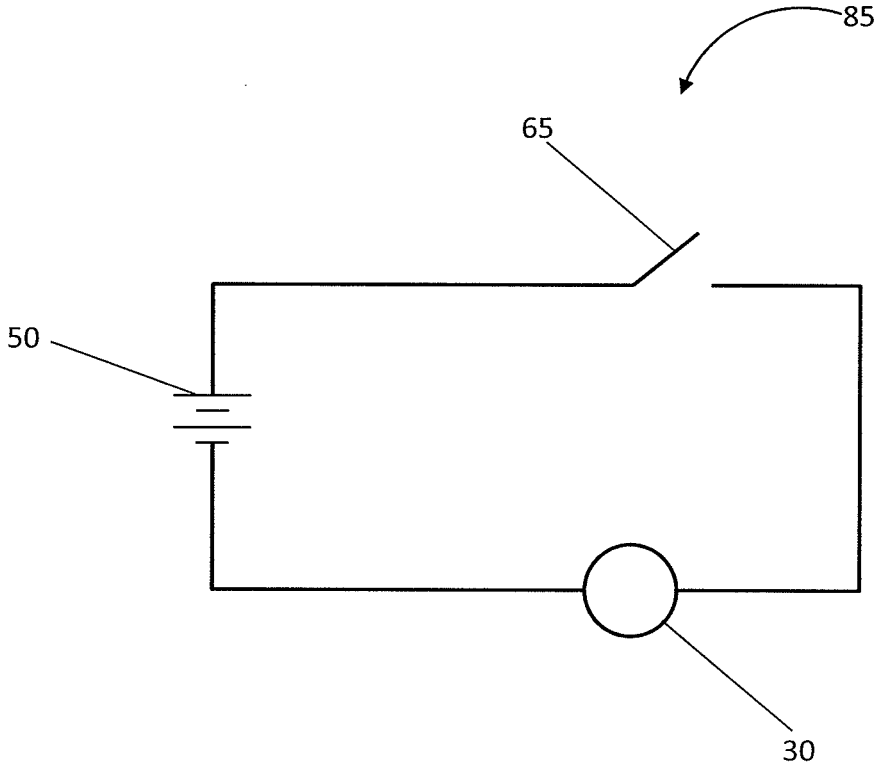
FIG. 3 is a circuit diagram of a portion of the embodiment shown in FIG. 1.

Referring now to FIG. 3, the electrical circuit 85 comprises a switch 65, electrically operated valve 30, and power source 50 (shown in FIG. 3 as a battery 50). The switch 65 comprises the two conductive strips 60, 70 on the index finger and thumb—the conductive strip 60 on the index finger or first switch contact and the conductive strip 70 on the thumb or second switch contact. In the unactuated state, where the two conductive strips 60, 70 are not in contact with each other, the switch 65, and thus the circuit 85, is open (see FIG. 3). When the two conductive strips 60, 70 come in contact with each other, the switch 65, and thus the circuit 85, is closed, which causes the electrically operated valve 30 to open and release the pressurized fluid contained in the reservoir 20.

The personal protection device 100 can be actuated, when desired by the wearer of the glove, by placing the thumb on the side of the middle finger and then placing the index finger on top of the thumb. The wearer, if desired, can also actuate the personal protection device 100 by closing the middle, ring, and small fingers into a fist, placing the surface of the thumb on the second knuckle of the middle finger, and then placing the index finger across the top of the thumb nail (forming the "got your nose" fist-like configuration shown in FIG. 2). These particular hand configurations required to actuate the personal safety device 100 reduce the possibility of accidental actuation and discharge of fluid from the device 100.

The conductive strip 60 on the index finger is then in contact with the conductive strip 70 on the top of the thumb. When the two conductive strips 60, 70 are in contact with each other, the low-voltage electrical circuit 85 is closed, which then powers the valve 30 to open and release the pressurized fluid (liquid or gas) from inside the reservoir 20.

The pressurized fluid is then released from the discharge end of the fluid delivery tube 40 located at the end of the wearer's thumb. The wearer of the personal protection device 100 can aim the sprayed fluid by simply pointing his/her thumb, while in the proper hand configuration, at the desired targeted.

The wearer can stop the release of the pressurized liquid by lifting his/her index finger from the top of the thumb, thereby breaking the contact between the conductive strips 60, 70, which opens the low-voltage electrical circuit 85, and, in turn, removes power from the valve 30 and ceases the release of the fluid. The wearer of the device 100 may continue to release all the fluid from the reservoir 20 by continuing to hold the index finger on top of the thumb, thereby keeping the low-voltage electrical circuit 85 closed. As previously discussed, in some embodiments, the reservoir 20 is removable and replaceable. Once all the fluid is dispelled from the reservoir 20, the reservoir may be removed and refilled or replaced with a new reservoir 20 pre-filled with the desired fluid.

Figure 4:
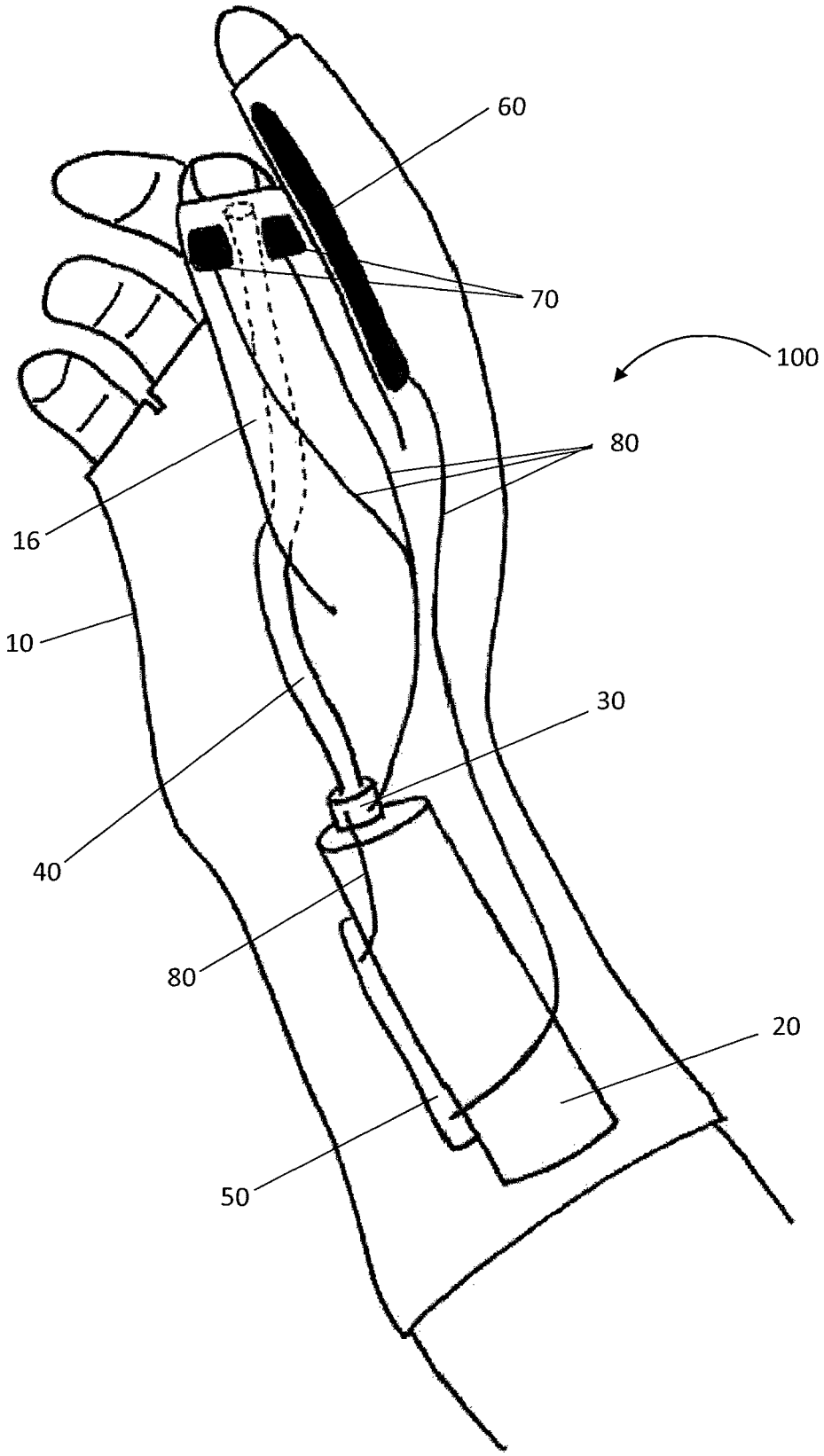
FIG. 4 is a perspective view of a right-handed embodiment of a personal protection devices installed on a hand and made in accordance with the principles described herein.

Referring now to FIG. 4, in this embodiment, the fluid delivery tube 40 extends from the valve 30 along the palm and terminates on the underside of the thumb covering 16 of the glove 10. In this embodiment, the strip 70 of electrically conductive substance on the thumb portion of the glove 10 comprises two strips—one on the right top side of the thumb between the knuckle and thumb nail, and the other on the left top side of the thumb between the knuckle and thumb nail. Though the underside fluid delivery tube 40 is shown in FIG. 4 with the two-piece thumb strip 70 on the top of the thumb portion of the glove 10, the underside fluid delivery tube 40 may also be used with the one-piece strip 70 shown in FIG. 1. Furthermore, the two-piece thumb strip 70 shown in FIG. 4 may be used with the fluid delivery tube 40 disposed on the top side of the thumb as shown in FIG. 1.

The personal protection device 100 thus allows for the non-accidental, immediately available, handgun-like, aimed spraying of a repellant without limiting the normal use and functioning of the hand upon which the device 100 is worn. Further, because the device is clearly visible in normal use, it may act as a deterrent to would-be assailants.

What is claimed is:

1. A personal protection apparatus comprising:
a glove;
a reservoir supported on the glove;
a fluid delivery tube in fluid communication with the reservoir;
a valve electrically operable to open and close and thereby control the flow of fluid from the reservoir into the delivery tube;
a power supply supported on the glove; and
a switch supported on the glove for electrically coupling the valve and the power supply the switch including a first switch contact and a second switch contact, wherein the first and second switch contacts are positioned on the glove so as to cone into engagement with one another when the wearers thumb is positioned between the wearer's index finger and middle finger, wherein the switch comprises a first contact on the index finger covering of the glove, and a second contact on the thumb covering of the glove, wherein the first contact is disposed on the bottom inside edge of the index finger covering, and wherein the second electrical contact is disposed on the top of the thumb covering on a segment of the thumb covering between the knuckle and the thumb nail.

2. The apparatus of claim 1, wherein the switch comprises a first contact on the index finger covering of the glove, and a second and third contact on the thumb covering of the glove.

3. The apparatus of claim 2, wherein the first contact is disposed on the bottom inside edge of the index finger covering, the second electrical contact is disposed on the left side of the top of the thumb covering between the knuckle and the thumb nail, and the third electrical contact is disposed on the right side of the top of the thumb covering between the knuckle and the thumb nail.

4. A personal protection apparatus comprising:
a glove;
a reservoir supported on the glove;
a fluid delivery tube in fluid communication with the reservoir;
a valve electrically operable to open and close and thereby control the flow of fluid from the reservoir into the delivery tube;
a power supply supported on the glove; and
wherein the fluid delivery tube has a discharge end adjacent to the thumb nail.

5. The apparatus of claim 1, wherein the fluid delivery tube is disposed on the underside of the thumb covering.

6. The apparatus of claim 1, wherein the reservoir contains an irritant.

7. The apparatus of claim 1, wherein the reservoir contains an inflammatory agent.

8. The apparatus of claim 1, wherein the reservoir contains water.

9. A personal protection apparatus for a wearer, comprising:
a glove comprising an index finger covering and a thumb covering, the index finger covering including a first switch contact and the thumb covering including a second switch contact, wherein the first and second switch contacts are positioned on the glove so as to come into engagement with one another when the wearer's thumb is positioned between the wearer's index finger and middle finger;

a reservoir supported on the glove and adapted for containing a fluid repellant;

a fluid delivery tube in fluid communication with the reservoir, wherein at least a portion of the tube is supported by the thumb covering;

an electrically actuatable valve configured to control the flow of repellant from the reservoir and through the tube; and a power supply supported by the glove and electrically coupled to the valve so as to actuate the valve when the first and second contacts are engaged.

10. The apparatus of claim 9, wherein the first contact is disposed on the bottom inside edge of the index finger covering, and wherein the second electrical contact is disposed on the top of the thumb covering on a segment of the thumb covering between the knuckle and the thumb nail.

11. The apparatus of claim 9, wherein the fluid delivery tube is disposed on the top of the thumb covering and has a discharge end adjacent to the thumb nail.

12. The apparatus of claim 9, wherein the fluid delivery tube is disposed on the underside of the thumb covering.

13. The apparatus of claim 9, wherein the reservoir contains an irritant.

14. The apparatus of claim 9, wherein the reservoir contains an inflammatory agent.

15. The apparatus of claim 9, wherein the reservoir contains water.

16. A method of actuating a switch, comprising:

placing a glove on the hand of a person;

placing a thumb covering of the glove between an index finger covering and a middle finger covering of the glove; and connecting conductive electrical contacts on the bottom inside edge of the index finger covering with the top of the thumb covering between the knuckle and the thumb nail;

wherein the glove comprises a reservoir configured to contain a fluid, a flexible tube, and a first and second electrical contact coupled to a power source and a valve.

17. A personal protection apparatus for a wearer, comprising:

a glove comprising an index finger covering and a thumb covering, the index finger covering including a first switch contact and the thumb covering including a second switch contact, wherein the first and second switch contacts are positioned on the glove so as to come into engagement with one another when the wearer's thumb is positioned between the wearer's index finger and middle finger;

a reservoir supported on the glove and adapted for containing a fluid repellant;

a fluid delivery tube in fluid communication with the reservoir;

an electrically actuatable valve configured to control the flow of repellant from the reservoir and through the tube; and a power supply supported by the glove and electrically coupled to the valve so as to actuate the valve when the first and second contacts are engaged.

18. A personal protection apparatus for a wearer, comprising:

a glove comprising a finger covering having a first electrically conductive strip and a thumb covering having a second electrically conductive strip, wherein the first and second electrically conductive strips are positioned on the glove so as to come into engagement with one another when the wearer's thumb is positioned between the wearer's index finger and middle finger;

a reservoir supported on the glove and adapted for containing a fluid repellant;

a fluid delivery tube in fluid communication with the reservoir; and a valve configured to control the flow of the fluid repellant from the reservoir and through the tube when the first and second electrically conductive strips come into engagement with one another.

* * * * *